US012138507B2

(12) United States Patent
Li et al.

(10) Patent No.: US 12,138,507 B2
(45) **Date of Patent: *Nov. 12, 2024**

(54) ELECTRIC TREADMILL

(71) Applicant: Johnson Health Tech. Co., Ltd., Taichung (TW)

(72) Inventors: Chih-Jen Li, Taichung (TW); Jhih-Sheng Fang, Taichung (TW)

(73) Assignee: Johnson Health Tech Co., Ltd., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/973,461

(22) Filed: Oct. 25, 2022

(65) Prior Publication Data

US 2023/0052012 A1 Feb. 16, 2023

Related U.S. Application Data

(63) Continuation of application No. 17/083,307, filed on Oct. 29, 2020, now Pat. No. 11,524,207.

(30) Foreign Application Priority Data

Nov. 8, 2019 (CN) ..... 201921920685.6

(51) Int. Cl.
*A63B 22/02* (2006.01)
*A63B 22/00* (2006.01)
(Continued)

(52) U.S. Cl.
CPC ..... *A63B 22/0235* (2013.01); *A63B 22/0023* (2013.01); *A63B 24/0087* (2013.01); *A63B 71/0054* (2013.01); *A63B 2071/0081* (2013.01)

(58) Field of Classification Search
CPC ..... A63B 22/0235; A63B 22/0023; A63B 24/0087; A63B 71/0054;
(Continued)

(56) References Cited

U.S. PATENT DOCUMENTS 3,209,225 A * 9/1965 Shafi-Uddin ..... H02P 3/24 318/369
5,070,290 A * 12/1991 Iwasa ..... B66B 5/02 318/758
(Continued)

FOREIGN PATENT DOCUMENTS

EP 1845605 A2 * 10/2007 ..... H02K 7/06
WO WO-2014077005 A1 * 5/2014 ..... A63B 22/0023

*Primary Examiner* — Shila Jalalzadeh Abyaneh

(57) ABSTRACT

An electric treadmill includes a motor and a motor driving circuit. The motor driving circuit is operable to control electric current flow from a positive electrode through the motor to a negative electrode to drive the motor. The motor driving circuit has a switch path connected between the positive electrode and the negative electrode. The switch path has a resistance element and a switch element connected in series. When the motor driving circuit receives power from the external power source, the switch element will automatically switch to an open state so that the resistance element is inactive; and when the motor driving circuit does not receive power from the external power source, the switch element will automatically switch to an closed state so that the resistance element is operated to provide a resistive load for stopping rotation of the endless belt.

6 Claims, 4 Drawing Sheets

(51) Int. Cl.
*A63B 24/00* (2006.01)
*A63B 71/00* (2006.01)

(58) Field of Classification Search
CPC .... A63B 2071/0081; A63B 2024/0093; A63B 22/025; A63B 2071/0072; A63B 2225/09
See application file for complete search history.

(56) References Cited

U.S. PATENT DOCUMENTS

| | | | | |
|---|---|---|---|---|
| 8,403,816 | B2 * | 3/2013 | Park | A63B 21/0053 482/8 |
| 10,680,538 | B2 * | 6/2020 | Nagarajan | H02P 3/14 |
| 2005/0113216 | A1 * | 5/2005 | Cheng | H02K 7/1016 482/4 |
| 2017/0001075 | A1 * | 1/2017 | Butler, Jr. | A63B 21/00076 |
| 2018/0085651 | A1 * | 3/2018 | Russo | A63B 24/0087 |

* cited by examiner

ELECTRIC TREADMILL

CROSS-REFERENCE TO RELATED APPLICATION

This is a continuation of application Ser. No. 17/083,307, filed Oct. 29, 2020, now U.S. Pat. No. 11,524,207.

BACKGROUND

1. Field of the Invention

The present invention relates to an exercise apparatus. More particularly, the present invention relates to an electric treadmill.

2. Description of the Related Art

Generally, an electrically-powered treadmill must use electric power from an external power source to drive a motor to run, thereby driving an endless belt on a platform to rotate circularly, so that a user is able to walk, jog, or run on the endless belt. When the external power is interrupted (e.g. power outage or blackout), or the treadmill is not plugged in, or the power switch of the treadmill is not turned on, the treadmill does not receive any electrical power. Without electrical power, the motor cannot control or restrain the endless belt, and the endless belt may be rotated due to an external forces. This is true for all currently available electrically-powered treadmills, and it is especially true for slat-belt treadmills. Since the endless belt of the slat-belt treadmill is supported by a plurality of bearings instead of conventional supporting deck which may rub against the endless belt, the rotational resistance or friction of the endless belt of the slat-belt treadmill is generally very low, and the endless belt may be very easily pushed or rotated by external forces. In practice, when an electric treadmill is not receiving power, it is obvious that the console of the treadmill has no lights or display thereon, but if a user does not notice it and directly steps on the treadmill, the user's feet may push the top surface of the endless belt to slide forward or backward, causing the user to lose their balance or fall.

In order to resolve the above-mentioned problem, a conventional electric treadmill may have a braking device that can be automatically switched depending on power conditions. The braking device includes an electromagnet, a brake member and a spring member. When the treadmill is powered on, the electromagnet is energized to move the brake member to a non-braking position, such that the brake member doses not affect rotation of the endless belt. When the treadmill is powered off or otherwise is not receiving electrical power from an outside source, the electromagnet has no magnetic force and the brake member would be pulled into a braking position by the spring member where the brake member is operable to abut against a flywheel which is coupled to the endless belt, thereby stopping rotation of the endless belt. However, the aforementioned braking device has high cost and some problems such as component loss and troublesome maintenance.

The present invention has arisen to mitigate and/or obviate the disadvantages of the conventional method. Further benefits and advantages of the present invention will become apparent after a careful reading of the detailed description with appropriate reference to the accompanying drawings.

SUMMARY

The present invention is directed to an electric treadmill. When the treadmill does not receive power to drive the motor, it will automatically stop rotation of the endless belt to avoid unexpected movement of the endless belt when a user steps on the belt.

According to one aspect of the present invention, a treadmill comprises a platform having a frame and an endless belt mounted around the frame, a motor coupled to the endless belt for driving the endless belt to rotate, and a motor driving circuit receiving power from an external power source. The motor driving circuit has a positive electrode, a negative electrode and a switch path. The motor driving circuit is operable to control electric current flow from the positive electrode through the motor to the negative electrode to drive the motor. The switch path has a resistance element and a switch element connected in series between the positive electrode and the negative electrode. When the motor driving circuit receives power from the external power source, the switch element will automatically switch to an open state so that the resistance element is inactive. When the motor driving circuit does not receive power from the external power source, the switch element will automatically switch to an closed state so that the resistance element is operated to provide a resistive load for stopping rotation of the endless belt.

Preferably, the motor is an AC motor and the motor driving circuit comprises a rectifier configured to convert alternating current from the external power source to direct current, and an inverter configured to convert the direct current to alternating current flowing through the motor. Specifically, the motor is a permanent-magnet synchronous motor having a three-phase winding and the inverter is a three-phase inverter.

Preferably, the resistance element is a power resistor configured to consume power generated by the motor. When the motor driving circuit does not receive power, the resistance element becomes a power load applied to the motor to stop rotation of the endless belt.

Preferably, the resistance element has a resistance value ranging from substantially 1.25Ω to a value less than 5Ω.

Preferably, the treadmill further comprises an inclination adjusting mechanism configured for adjusting an angle of the platform relative to a ground. When the motor driving circuit does not receive power, even if the platform of the electric treadmill is inclined at a maximum inclination angle and a user stands on the endless belt, a sliding speed of the endless belt will not exceed 1 mph.

Further benefits and advantages of the present invention will become apparent after a careful reading of the detailed description with appropriate reference to the accompanying drawings.

DETAIL DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
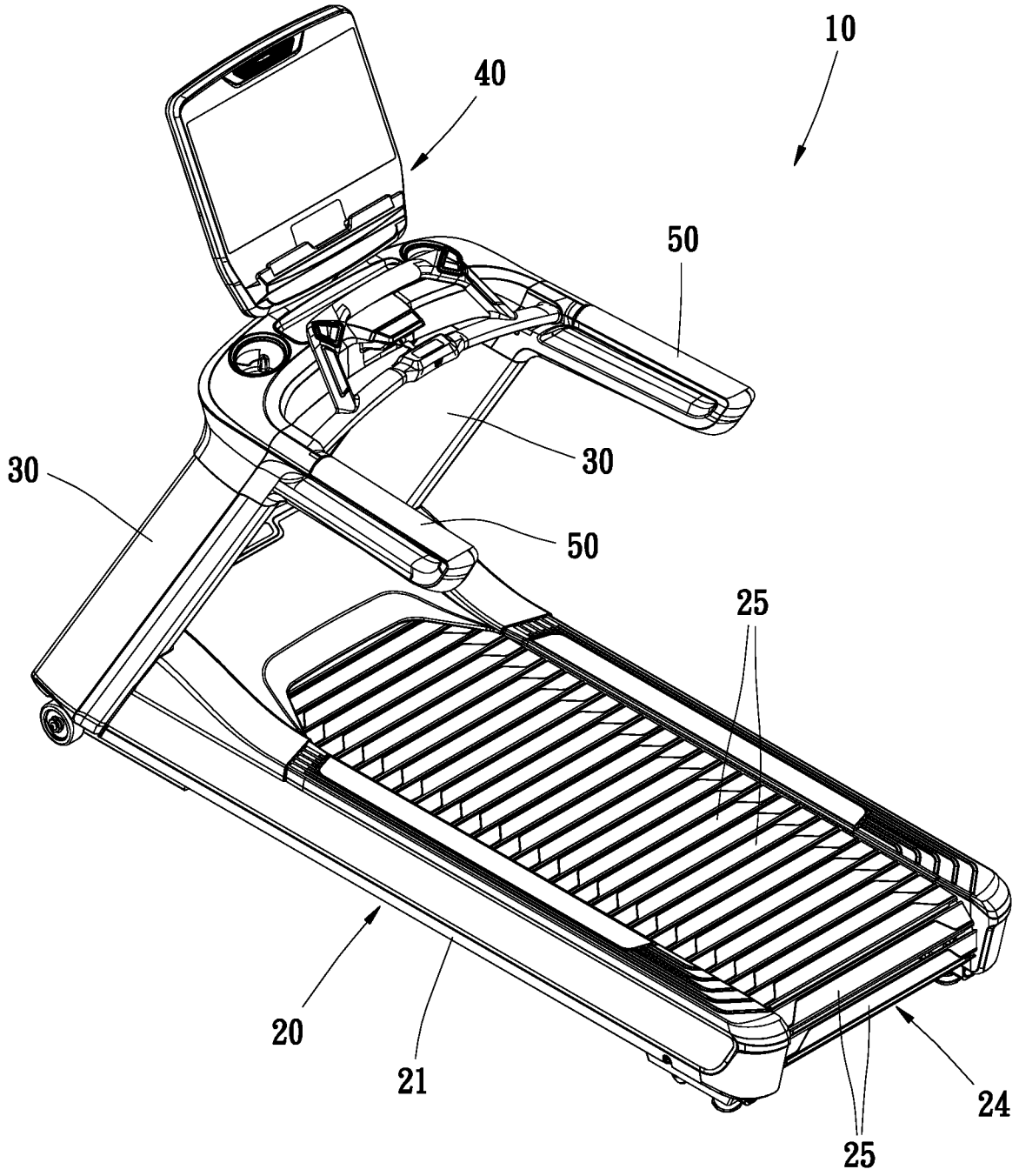
FIG. 1 is a perspective view of an electric treadmill in accordance with a preferred embodiment of the present invention.
Figure 2:
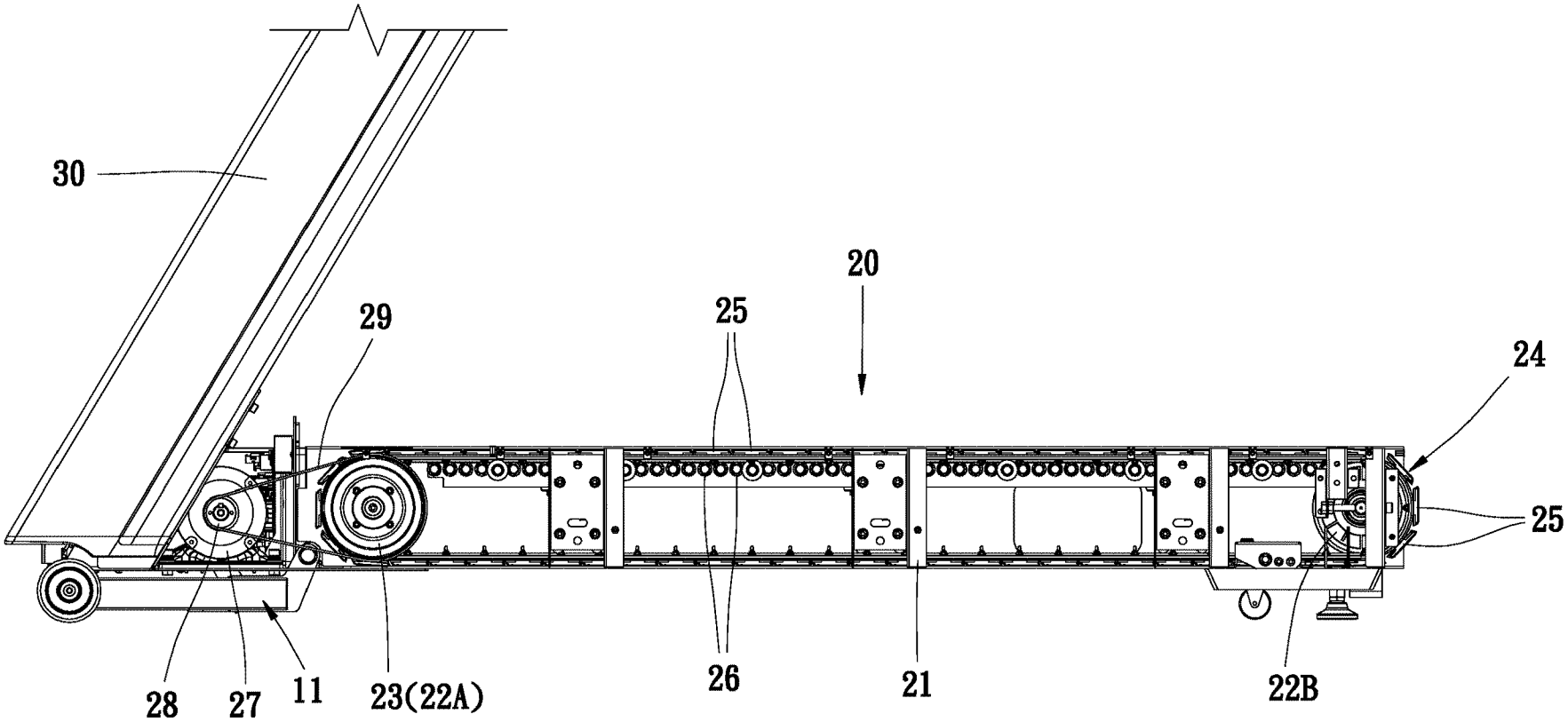
FIG. 2 is a left side view of the lower half of the electric treadmill shown in FIG. 1, wherein the side cover is removed for showing the internal structure.

Referring to FIG. 1 and FIG. 2, an electric treadmill 10 is illustrated in accordance with a preferred embodiment of the present invention. The treadmill 10 includes a platform 20 supported by the ground, left and right uprights 30 extending upwardly from the front end of the platform 20, a console 40 mounted on the top end of the left and right uprights 30, and left and right handrails 50 respectively extending rearwardly from the top ends of the left and right uprights 30.

The platform 20 has a frame 21, a front roller 22A, a rear roller 22B, and an endless belt 24. The front roller 22A is rotatably and transversely mounted on the front end of the frame 21. The rear roller 22B is rotatably and transversely mounted on the rear end of the frame 21. The endless belt 24 is mounted around the front roller 22A and the rear roller 22B, such that the endless belt 24 can be circularly revolved around the frame 21 and provides an exercise surface for allowing a user to walk or run on the exercise surface while staying in substantially the same place. In the preferred embodiment of the present invention, the endless belt 24 is a slat belt or track belt, including a plurality of elongated slats 25 extending transversely. The slats 25 are arranged parallel to each other and oriented perpendicular to an axis of rotation of the endless belt 24. The slats 25 are attached to each other to form a closed loop. As shown in FIG. 2, the elongated slats 25 are supported by a plurality of bearings 26 which are arranged on the frame 21 of the platform 20.

Referring to FIG. 2, an electric motor 27 is mounted on the front end of the frame 21. The motor 27 is coupled to the front roller 22A via a driving mechanism for driving the endless belt 24 to rotate with respect to the frame 21. The driving mechanism includes a small pulley 28 coaxially coupled to the motor shaft of the motor 27, a large pulley 23 coaxially coupled to the front roller 22A, and a driving belt 29 mounted around the small pulley 28 and the large pulley 23. When the motor 27 is running, the front roller 22A will be driven to rotate at a lower rotational speed than the rotational speed of the motor shaft, but at a higher torque than the motor shaft, so that the endless belt 24 can be driven to rotate circularly at a corresponding speed for allowing a user to perform walking, running or jogging on the top surface of the endless belt 24. Note that the structure of the aforementioned platform 20 is prior art in the field of treadmills, so it is only briefly described here. The main technical feature of the present invention is about a motor driving circuit in the electric treadmill for the operation of the endless belt. The motor driving circuit can be applied to platforms of various electrically-powered treadmills. For example, the motor driving circuit can also be applied to a traditional motorized treadmill with a deck supported on the frame and an endless belt rotating around the deck and partially supported by the deck for allowing a user to exercise thereon.

In the preferred embodiment of the present invention, the treadmill 10 has an inclination adjusting mechanism 11 mounted on the front end of the frame 21. The inclination adjusting mechanism 11 is operable to adjust the angle of the platform 20 relative to the ground, so that the inclined angle of the platform 20 of the treadmill 10 can be electrically or manually adjusted relative to the ground. Therefore, the user can adjust the exercise surface of the endless belt 24 to a horizontal state or an inclined state. The aforementioned inclination adjusting mechanism 11 is a conventional technique in the art of treadmills, which is not limited in the present invention. In another preferred embodiment, the treadmill may not have the inclination adjusting mechanism, and therefore in this embodiment, the inclined angle of the platform cannot be adjusted.

Figure 3:
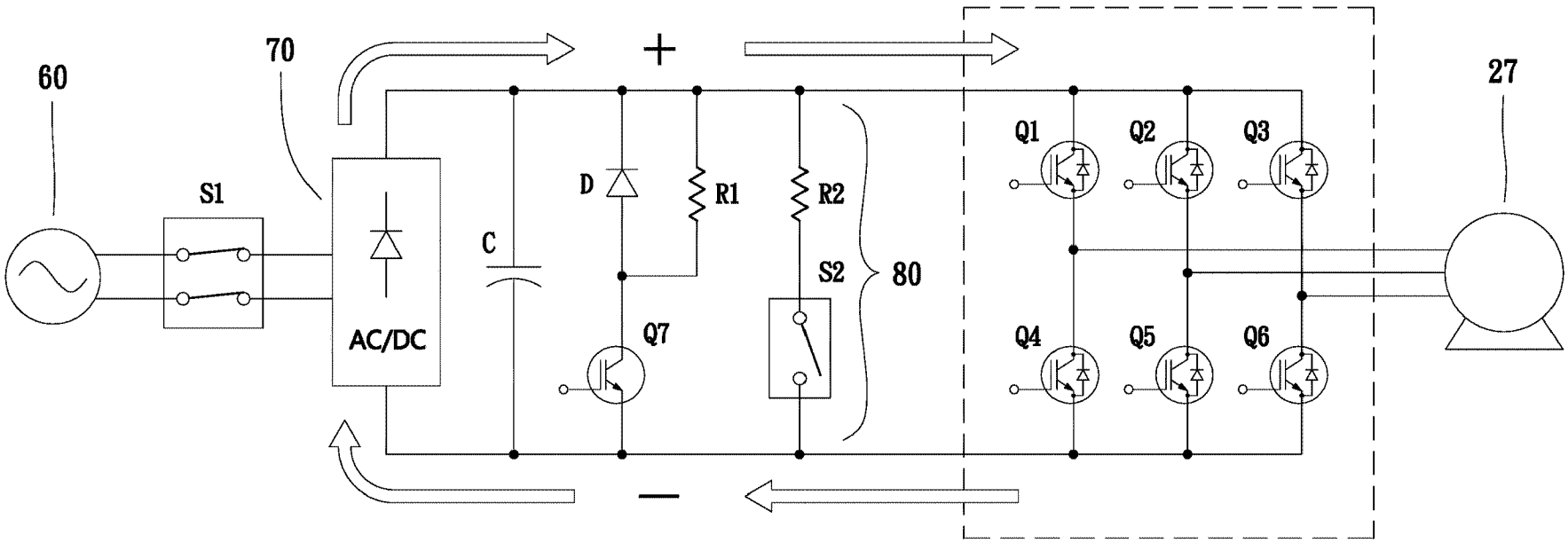
FIG. 3 is a schematic circuit diagram of a motor driving circuit of the electric treadmill in the preferred embodiment of the present invention, showing a state of the circuit when it receives power from an external power source.

FIG. 3 illustrates a schematic circuit diagram of the motor driving circuit of the treadmill 10. The symbol of the motor 27 shown on the right of the circuit diagram represents the motor 27 configured to drive rotation of the endless belt 24. An AC (alternating current) power source 60 shown on the left of the circuit diagram represents an external power source for providing AC power to the treadmill 10, such as AC 110V or AC 220V power source which usually provides electricity through a power cord and a power switch (not shown) to the treadmill 10. As shown in FIG. 3, the circuit between the AC power source 60 and the motor 27 is defined as the aforementioned motor driving circuit. When the AC power source 60 is normally supplied, the motor driving circuit can drive and control the motor 27 to operate the motor 27 at a predetermined chosen speed (including acceleration and deceleration) or to stop rotation of the motor 27. It should be noted that FIG. 3 simply represents main parts of the motor driving circuit. In practice, the motor driving circuit may have some electronic components or circuit units, such as digital signal processors (DSP) and feedback circuits. In general, a central control unit (not shown) of the treadmill 10 is arranged in the console 40, which is operable to control the motor driving circuit based on a predetermined principle and the user's commands. In other words, the central control unit is operable to control operation of the motor driving circuit, the motor 27 and the endless belt 24. The central control unit may also control other things such as an inclination adjusting mechanism, and the central control unit may perform other functions as well such as feedback displays for the user.

In the preferred embodiment of the present invention, the motor driving circuit includes a rectifier 70, such as a single-phase bridge rectifier, which can convert alternating current (AC) from the AC power source 60 to direct current (DC). The rectifier 70 has a pair of output terminals which constitute a DC bus of the motor driving circuit, including a positive pole marked "+" in the upper part of the figure, and a negative pole marked "–" in the lower part of the figure. A capacitor C is connected between the positive pole and the negative pole to perform filtering and smoothing functions to maintain the output voltage of the rectifier 70 at a rated value (e.g. 310V). In other words, when the AC power source 60 is normally supplied, a predetermined potential difference will be maintained between the positive pole and the negative pole of the motor driving circuit. The motor driving circuit further has a diode D, a first resistor R1 and a transistor Q7 to form an overvoltage protection circuit. When the motor driving circuit detects that the voltage between the positive pole and the negative pole exceeds a rated value (e.g. using a detection circuit or mechanism), the aforementioned digital signal processor (DSP) will control the transistor Q7 to switch between "ON" and "OFF" state, forming a step-down effect to protect the circuit and the motor 27. The aforementioned overvoltage protection circuit is a conventional technique well known in the art, which is not limited in the present invention.

In the preferred embodiment of the present invention, the motor 27 is a permanent magnet motor, and specifically a permanent-magnet synchronous motor (PMSM) with three-phase winding. The six transistors Q1~Q6 (e.g. Insulated Gate Bipolar Transistor, IGBT) and the related wires shown in FIG. 3 constitute a three-phase inverter. The aforementioned digital signal processor (DSP) can be operable to control the ON/OFF states of the transistors, and convert the aforementioned direct current of the DC bus to three-phase alternating current, so that the electric current flows from the positive pole through the motor 27 to the negative pole (as indicated by the arrows in FIG. 3) and drives the motor 27 to operate at a predetermined speed. The aforementioned permanent-magnet synchronous motor (PMSM) and the driving method are well known in the art, which is not limited in the present invention.

Referring to FIG. 3, the motor driving circuit has a first switch element S1, specifically an AC relay, arranged before the input terminal of the rectifier 70. When the AC power source 60 is normally supplied and delivering power into the motor driving circuit, the first switch element S1 will be automatically maintained in a closed state, that is, the alternating current from the AC power source 60 could flow through the first switch element S1 to the rectifier 70, thereby outputting direct current with a rated voltage, and generating electric current for driving the motor 27 (as indicated by the arrows shown in FIG. 3). In contrast, when the motor driving circuit does not receive alternating current from the AC power source 60, for example, in situations of a power outage (also called a power blackout or no grid power), or if the treadmill is not plugged in, or the power switch of the treadmill is not turned on, the first switch element (AC relay) S1 will automatically switch to an OFF state or open state, as shown in FIG. 4.

As shown in FIG. 3, the motor driving circuit has a switch path 80. The switch path 80 has a first node (the top end of the switch path 80 in the figure) connected to the aforementioned positive pole of the motor driving circuit, and a second node (the bottom end of the switch path 80 in the figure) connected to the aforementioned negative pole of the motor driving circuit. In the preferred embodiment of the present invention, the switch path 80 includes a second resistance element R2 and a second switch element S2 connected in series between the first node and the second node. The second resistance element R2 is specifically a power resistor. The second switch element S2 is specifically a DC relay. When the motor driving circuit receives alternating current from the AC power source 60 and the rectifier 70 outputs direct current with a rated voltage, the second switch element S2 will automatically switch to an OFF state or open state so that the switch path 80 between the first node and the second node is in an open state, and the second resistance element R2 is effectively removed from the circuit, as shown in FIG. 3. In contrast, when the motor driving circuit does not receive alternating current from the AC power source 60, the rectifier 70 does not output direct current, and the second switch element S2 will automatically switch to an ON state or closed state so that the switch path 80 between the first node and the second node is in a closed state. When the second switch element S2 is closed, the second resistance element R2 becomes a load connected between the positive pole and the negative pole of the motor driving circuit, and this resistive load acts to stop rotation of the endless belt 24.

Figure 4:
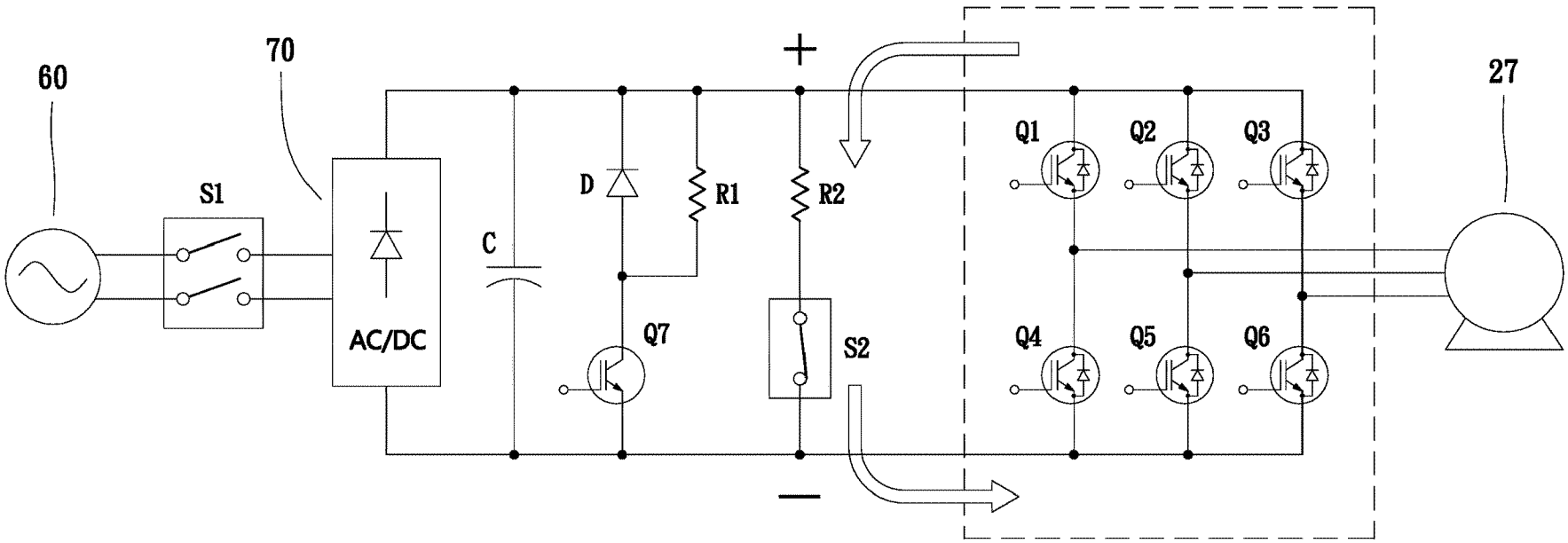
FIG. 4 is similar to FIG. 3, showing another state of the circuit when the motor driving circuit does not receive power from the external power source.

Referring to FIG. 4, when the motor driving circuit does not receive alternating current from the AC power source 60, for example, in situations of a power outage, the motor 27 will become a generator and rotation of the endless belt 24 will drive rotation of the motor shaft to generate electrical energy, and the generated electric current will flow through the switch path 80 to form a circuit, as indicated by the arrows shown in FIG. 4. In the preferred embodiment of the present invention, the switch path 80 is provided with a power resistor (namely the second resistance element R2), and the power resistor has a relatively low resistance value and a relatively high power value. For example, the power resistor has a power value of 300 W and a resistance value of 1.25Ω. When the treadmill 10 loses power, the motor 27 also loses power at the same time, and the motor 27 may be driven by externally generated rotation of the endless belt 24, such that the motor 27 acts like a generator to generate electric current. Since the second resistance element R2 has a relatively low resistance value, the electric current generated by the motor 27 will be relatively high, which may simultaneously apply a relatively high magnetic force on the rotor of the motor 27 to resist movement of the motor shaft for stopping rotation of the endless belt 24. It should be noted that since the second resistance element R2 has a relatively low resistance value, the switch path 80 may approach a short circuit state such that the electric current generated by the motor 27 will be very large. Therefore, once the motor 27 suddenly lose power, the motor 27 will become difficult to rotate so as to resist rotation of the endless belt 24. In another embodiment, the switch path 80 may not have any power resistor, rendering the motor 27 in a short circuit state to brake rotation of the motor shaft and rotor.

Under this arrangement, for example, when the power of the treadmill is not turned on, or the motor driving circuit does not receive electricity to drive the motor 27 for any reason, the second switch element S2 is closed and the switch path 80 between the first node and the second node is in a closed state. If an external force pushes the endless belt 24 of the treadmill 10 to rotate, the force will be transmitted through the endless belt 24, the roller 22A, the large pulley 23, the driving belt 29 and the small pulley 28 to drive the motor shaft and the rotor of the motor 27 to rotate, such that the motor 27 acts like a generator to convert the kinetic energy for driving the rotor of the motor into the electrical energy. The generated electric current will flow through specific terminals and the upper transistors Q1/Q2/Q3 of the three-phase inverter from the respective coil in the motor 27 to the aforementioned positive pole, then flow through the switch path 80 which is in the closed state at this time to the aforementioned negative pole, and then return to the respective coil in the motor 27 through the lower transistors Q4/Q5/Q6 of the three-phase inverter and the specific terminals, forming a current loop. The second resistance element R2 of the switch path 80 is provided for consuming power as a load for the motor 27 to generate electricity, forming a resistance against rotation movement of the endless belt 24. Therefore, the endless belt 24 is not easy to rotate in this state.

In the preferred embodiment of the present invention, when the angle of the platform 20 relative to the ground is adjusted to reach or approach a maximum inclination angle, for example, when the platform 20 of the treadmill 10 is inclined at a grade of 20% relative to the substantially horizontal floor surface, the inclination angle of the top surface of the endless belt 24 is presented at 20% grade with respect to the ground. With this maximum incline angle of the platform 20 of the treadmill 10, any downward load (such as bodyweight of a user on the treadmill platform 20) will apply a portion of that load backwards along the surface of the inclined platform 20 to externally drive the rotation of the treadmill platform 20. Once the motor 27 loses power, even if a user weighing 120 kg stands on the endless belt 24, the top surface of the endless belt 24 will slide backward and downward due to the weight of the user. With no resistive load applied by the treadmill during this unpowered state of the motor 27, the slide speed of the endless belt 24 could become quite high, leading to possibly dangerous speeds or accelerations. But with the addition of a resistive load applied by the treadmill during this unpowered state of the motor 27, it is possible to drastically reduce both the acceleration and the maximum slide speed of the endless belt 24. It is desirable to ensure that the slide speed of the endless belt 24 will not exceed 1 mph (approximately 1.6 km/h). It is conceivable that when the grade of the top surface of the endless belt 24 is less than 20%, and/or the weight of the user is less than 120 kg, the endless belt 24 is less likely to slide, or the sliding speed is very slow. Therefore, when the treadmill 10 of the present invention does not receive power, for example, when the treadmill 20 is not plugged in or the power switch of the treadmill is not turned on, if a user directly steps on the treadmill 20 without noticing it, the resistive load from the unpowered motor driving circuit provides resistance to the motion of the endless belt 24. Due to this feature of the unpowered motor driving circuit, the slide speed of the endless belt 24 can be drastically reduced, preventing dangerous slide speeds, especially when the top surface of the endless belt 24 is horizontal. Even if the endless belt 24 slides, the speed of the endless belt 24 is very slow, so that the user will not lose balance or fall, reducing the risk of injury.

When using the electric treadmill 10 of the present invention for performing exercise (e.g. running), if a power outage occurs or the electric power is otherwise removed, the first switch element S1 of the motor driving circuit will automatically switch to OFF (open) state, and the second switch element S2 will automatically switch to ON (closed) state at the same time, so that the second resistance element R2 becomes a power load applied to the motor 27 to counter any rotation of the endless belt 24. The resistance mechanism of the present invention is unlike conventional mechanical braking devices which are generally operated to quickly stop rotation of the corresponding transmission components (e.g. flywheel). The resistance mechanism of the present invention is smoother than conventional mechanical braking devices. It will not cause the user to be in danger due to the sudden stop of the endless belt. In addition the resistance mechanism of the present invention has advantages of low cost and low maintenance.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A motor brake device for stopping rotation of an endless belt of an electric treadmill when the electric treadmill does not receive power from an external power source, the motor brake device comprising:

a motor coupled to the endless belt for driving the endless belt to rotate; and a motor driving circuit, connected to the motor and configured to receive power from the external power source, comprising; a positive electrode, a negative electrode and a switch path, the switch path having a resistance element and a switch element connected in series between the positive electrode and the negative electrode, the switch element being a DC relay, the motor driving circuit further configured to control electric current flow from the positive electrode through the motor to the negative electrode to drive the motor;

wherein when the motor driving circuit receives power from the external power source, the switch element automatically switches to an open state so that the resistance element is inactive and the motor is operable to drive the endless belt to rotate, and when the motor driving circuit does not receive power from the external power source, the switch element automatically switches to a closed state, and the resistance element is operated to provide a resistive load for stopping rotation of the endless belt; and wherein when the motor driving circuit does not receive power from the external power source, the switch element automatically switches to a closed state, the resistance element becomes a load for consuming power generated by the motor when the endless belt is driven by an external force, such that the motor operates to resist rotation of the endless belt and ensure a sliding speed of the endless belt will not exceed 1 mph.

2. The motor brake device as claimed in claim 1, wherein the motor is an AC motor, the motor driving circuit comprising a rectifier configured to convert alternating current from the external power source to direct current, and an inverter configured to convert the direct current to alternating current flowing through the motor.

3. The motor brake device as claimed in claim 2, wherein the motor is a permanent-magnet synchronous motor having a three-phase winding and the inverter is a three-phase inverter.

4. The motor brake device as claimed in claim 1, wherein the resistance element is a power resistor configured to consume power generated by the motor, and when the motor driving circuit does not receive power, the resistance element becomes a power load applied to the motor to stop rotation of the endless belt.

5. The motor brake device as claimed in claim 4, wherein the resistance element has a power value of 300 W and a resistance value of 1.25Ω.

6. The motor brake device as claimed in claim 1, wherein the resistance element has a resistance value ranging from substantially 1.25Ω to a value less than 5Ω.

* * * * *